US006481355B2

(12) United States Patent
Weber

(10) Patent No.: US 6,481,355 B2
(45) Date of Patent: Nov. 19, 2002

(54) BOMBLET FUZE WITH SELF-DESTRUCT MECHANISM

(75) Inventor: Adolf Weber, Neunkirchen (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 09/928,986

(22) Filed: Aug. 15, 2001

(65) Prior Publication Data

US 2002/0020322 A1 Feb. 21, 2002

(51) Int. Cl.[7] ..... F42C 1/02
(52) U.S. Cl. ..... 102/275; 102/264; 102/266; 102/274
(58) Field of Search ..... 102/264, 266, 102/274, 275

(56) References Cited

U.S. PATENT DOCUMENTS 3,707,912 A * 1/1973 Duncan et al. ..... 102/336 X
3,815,505 A * 6/1974 Roh et al. ..... 11/11 X
4,703,693 A * 11/1987 Spies et al. ..... 102/215
5,147,975 A * 9/1992 Munach et al. ..... 102/264
5,549,047 A * 8/1996 Borgni ..... 102/256
5,841,059 A * 11/1998 Laurend et al. ..... 102/213
6,244,184 B1 * 6/2001 Tadmor ..... 102/206

* cited by examiner

*Primary Examiner*—Peter A. Nelson
(74) *Attorney, Agent, or Firm*—Venable; Norman N. Kunitz

(57) ABSTRACT

A priming unit, consisting of a combination of rested casings 5, 6, 7, a firing pin 3 with assembly aid 12, as well as a priming spring 8 and a propulsion spring 9, are arranged to provide a secure detonation of a fuze or bomblet fuze. The priming unit ensures a secure detonation upon impact with a target or at the completion of the flight phase. As a result, almost no duds are created. If, for any reason, the detonator carrier has not been armed, it is maintained in the unarmed position as a result of the arrangement, so that no dangerous duds result.

2 Claims, 1 Drawing Sheet

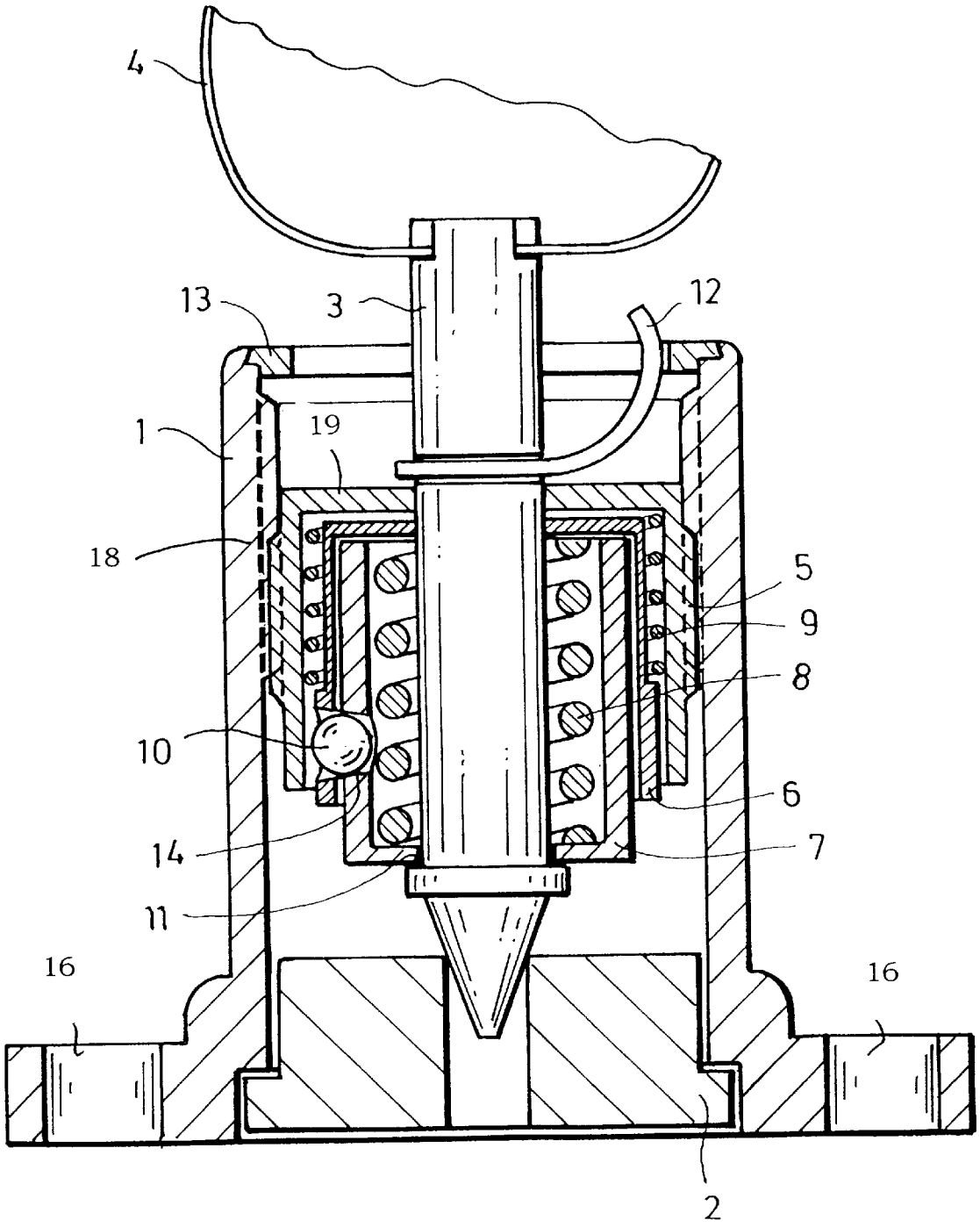
4
13
3
12
1
19
18
5
9
8
10
6
14
7
11
16
16
2

BOMBLET FUZE WITH SELF-DESTRUCT MECHANISM

CROSS REFERENCE TO RELATED APPLICATION

This application claims the priority of German Patent Application No. 100 40 800.1 filed Aug. 21, 2000, which is incorporated herein by reference.

BACKGROUND OF THE INVENTION

The invention relates to a bomblet fuze for bomblets used in projectiles and missiles, which are ejected following a specified flight interval, at an altitude of several hundred meters and become effective upon impact with the ground or another target.

It is known to use a bomblet fuze, such as the M223 that is activated upon impact with relatively hard targets because of its inertia-dependent operation. However, such fuzes are subject to a high number of malfunctions when impacting with soft ground, for example, the desert, sand and snow. As a result, numerous dangerous duds that pollute the terrain are created, which is of particular importance to follow-up units.

Also known are bomblet fuzes provided with pyrotechnical self-destruct units in addition to the impact detonator, which is similar to the one for the M 223. These additional pyrotechnical self-destruct units are very involved and costly because long burning times of up 40 seconds and more must be realized within a small area. They also have the disadvantage that with frequently occurring shorter flight times, bomblets not ignited upon impact remain on the ground for relatively long periods before they are detonated with the pyrotechnical ignition cord. Follow-up units must wait during these times (with reserve).

SUMMARY OF THE INVENTION

It is the object of the invention to provide a bomblet fuze with a self-destruct feature, which is activated immediately following impact with an optional target (even a soft target such as sand and snow) and not following a constant time interval after the ejection. The fuze should be considerably cheaper to produce, as compared to pyrotechnical solutions, which is of enormous importance given the large quantity for each carrier.

Technically, this object generally is achieved according to the invention with a priming unit consisting of several nested casings, which are fitted one into the other and are provided with priming springs. More specifically, the above object generally is achieved according to the present invention by a bomblet fuze that comprises:

a fuze housing having a cylindrical interior that is open at one end and has an end well at its opposite end with a central or axial opening for a firing pin;

a detonator carrier disposed within the housing adjacent its open end;

a firing pin axially disposed in the housing ant having a firing end facing the detonator carrier and an opposite end that extends out of the housing via the opening and is connected to a stabilizing band.

first, second and third nested casings, each being open at one end and closed at its other end by a respective end wall having an opening for the firing pin, with the first casing having its open end facing the open end of the housing and a side-wall whose outer surface is connected to an inner wall of the housing via a screw connection such that the first casing can move axially relative to the housing from a first position where the firing end of the firing pin is adjacent the detonation carrier and a second position where the firing end of the firing pin is spaced from the detonation carrier and the end wall of the first casing abuts said end wall of said housing, with the second casing being disposed in the first casing with its open end facing the open end of the housing and of the first casing, and being connected to the first casing for relative axial movement via a normally compressed propulsion spring tending to move the second casing in an axial direction toward the open end of the housing, and with the third casing being disposed in the second casing with its end wall facing the open end of the housing and being connected to the firing pin for movement therewith;

a priming spring disposed in the third casing between the closed end wall of the second casing and the closed end wall of the third casing for moving the third casing and said firing pin toward the detonator carrier disposed at the open end of the housing;

an inwardly tapered conical bore formed in the side walls of the second and third casings at a position normally within the first casing near the open end of the first casing; and a ball disposed in the conical bore of the second and third casings for preventing relative movement between the second and third casings while maintaining the priming spring in a compressed state, whereby, following unscrewing of the first casing, striking a target or the ground causes axial movement of the second and third casings by the propulsion spring and inertial forces sufficient to release the ball and permit the third casing and the firing pin to move axially and strike the detonator carrier.

One exemplary embodiment is shown in the FIGURE and is used in the explanation below.

BRIEF DESCRIPTION OF THE DRAWINGS

FIG. 1 is a schematic cross section of a fuze according to the invention just prior to the start of its operational sequence, i.e., in the fully assembled state prior to arming.

DETAILED DESCRIPTION OF THE PREFERRED EMBODIMENT

FIG. 1 shows a known fuze casing 1 (with fuze), which is to be riveted onto a bomblet via rivets (not shown) extending through eyelets 16. The housing 1 has a generally cylindrical interior shape and a detonation carrier 2 is disposed at the normally open end of the housing 1, which is to be adjacent to the bomblet. The opposite end of the housing 1 is provided with a plate, end wall or abutment 13 having a central opening for the passage of the firing pin 3 that is disposed along the axis of the housing 1 for axial movement. The end of the firing pin 3 extending out of the housing 1 is connected to a stabilizer band 4 that, in a known manner, is deployed once the bomblet to which the fuze is connected is ejected for descent.

Also disposed in the interior of housing 1, are three nested generally cylindrical casings 5, 6 and 7, which together with the springs 8 and 9 to be described later are generally referred to as the priming unit. The three casings 5 to 7, which are all closed at one end by a respective end wall with a respective opening for the passage of the firing pin 3, are disposed within the housing 1 such that the open ends of the casings 5 and 6 face in a direction toward the open end of the housing 1, whereas the third casing 7 is disposed within the casing 6 such that its closed end wall faces the open end of the housing 1 and its open end faces in the opposite direction toward the abutment plate or end wall 13. The outer surface of the casing 5 is connected to the inner wall of the housing 1 via a screw thread 18 with a large pitch so that the casing 5 may be screwed into the housing 1 and cause axial displacement of the firing pin 3 from the initial position shown to a position where the end wall 19 of the casing 5 abuts the end wall 13 of the housing 1. The casing 6 is connected to the casing 5 via a normally compressed propulsion spring 9 that, as shown, surrounds an upper portion of the casing 6. The innermost casing 7 is connected in a press-fit or form-locking connection with the firing pin 3 at its lower end 11 and contains a priming spring 8 which surrounds the firing pin 3 within the casing 7.

To prevent relative movement between the casings 6 and 7 until actuation of the detonation carrier 2 is desired, the side walls of the casings 8 and 7 are provided with a inwardly tapering conical bore 14, and a ball or ball-bearing 10 is disposed within the conical bore 14. As a result, no relative movement between the casing 6 and 7 is possible as long as the ball 10 is retained within the bore 14. As shown, the bore 14 is disposed within the side-walls of the casings 6 and 7 so that it is normally within and faces the inner wall of the casing 5, which retains the ball 10 in the bore 14, and causes compression of the spring 8.

Finally, in the position shown, an assembly aid 12 is connected to the firing pin 3 and engages in an opening in the end or abutment plate 13 for the housing 1 and simply maintains the firing pin 3, and thus the casings 5 to 7 with the springs 9 and 10 in their proper position prior to connection of the fuze unit to a bomblet. However, once the housing 1 is riveted to the bomblet, the assembly aid 12 is removed so that the fuze can function and the firing pin 3 move in its desired manner.

The fuze according to the invention operates as follows:

Following the ejection of a bomblet, the stabilizing band 4 unfolds in a known manner and the aerodynamic forces acting on the bomblet via the firing pin 3 and the press fit 11 between the firing pin 3 and the casing 7, will unscrew the priming unit via the external thread on casing 5 and move the priming unit axially until end wall of the casing 5 strikes the formed-in circular edge or end wall 13 of the housing 1. As a result, the safety of detonator carrier 2 is released and the detonator is subsequently armed with a propulsion spring in the manner known per se (M223). During the flight following the ejection of a bomblet, the priming unit is held together, even counteracting the force of the propulsion spring 9. Upon impact with a target or the ground at the end of a flight phase, the casings 6 and 7 and the firing pin 3 are moved in the direction of the detonator carrier 2 (downward in the illustration) by the propulsion spring 9 and the inertial forces. Following a small longitudinal or axial movement sufficient for the bore 14 with the ball 10 (several balls can also be distributed over the circumference) to move outside of the casing 5, the ball 10 is released and slides toward the outside through the conical bore 14 and driven by the priming spring 8. Once the ball 10 is released from the bore 14, casing 7 is free to move axially independently of casing 6 under the force of compressed priming spring 8, resulting in the firing pin 3 striking the detonator carrier 2 to detonate the bomblet. The priming spring 8 supplies sufficient priming energy for firing the detonator 2, regardless of the bomblet delay and even for soft targets. In the event the detonator carrier 2 has not been armed due to unfavorable conditions, this fuze maintains and keeps the detonator in the safety position after the above-described functional sequence is completed and no dangerous duds are created.

The invention now being fully described, it will be apparent to one of ordinary skill in the art that many changes and modifications can be made thereto without departing from the spirit or scope of the invention as set forth herein.

What is claimed is:

1. A bomblet fuze comprising:

a fuze housing having a cylindrical interior and being open at one end and having an end well at its opposite end with a central or axial opening for a firing pin;

a detonator carrier disposed within said housing adjacent said open end;

a firing pin axially disposed in said housing and having a firing end facing said detonator carrier and an opposite end that extends out of said housing via said opening and is connected to a stabilizing band;

first, second and third nested casings, each being open at one end and closed at its other end by a respective end wall having an opening for the firing pin, with the first casing having its open end facing the open end of the housing and a side-wall whose outer surface is connected to an inner wall of the housing via a screw connection such that the first casing can move axially relative to said housing from a first position where said firing end of said firing pin is adjacent said detonation carrier and a second position where said firing end of said firing pin is spaced from said detonation carrier and said end wall of said first casing abuts said end wall of said housing, with the second casing being disposed in the first casing with its open end facing the open end of the housing and of the first casing, and being connected to the first casing for relative axial movement via a normally compressed propulsion spring tending to move the second casing in an axial direction toward the open end of the housing, and with the third casing being disposed in the second casing with its end wall facing the open end of the housing and being connected to the firing pin for movement therewith;

a priming spring disposed in said third casing between the closed end wall of said second casing and the closed end wall of said third casing for moving said third casing and said firing pin toward the detonator carrier disposed at the open end of said housing;

an inwardly tapered conical bore formed in the side walls of said second and third casings at a position normally within said first casing near said open end of said first casing; and a ball disposed in said conical bore of said second and third casings for preventing relative movement between the second and third casings while maintaining said priming spring in a compressed state, whereby, following unscrewing of said first casing, striking a target or the ground causes axial movement of said second and third casings by said propulsion spring and inertial forces sufficient to release said ball and permit said third casing and said firing pin to move axially and strike said detonator carrier.

2. A fuze according to claim 1, further comprising an assembly aid for connecting said firing pin to said housing to prevent axial movement of said firing pin relative to said housing and prevent premature detonation of said fuze, said aid being removed after installation of said fuse on a bomblet to permit activation thereof.

* * * * *